United States Patent [19]

Suzuki

[11] 4,362,299

[45] Dec. 7, 1982

[54] AMUSEMENT DEVICE WITH FLUID MOVABLE ARTICULATED MEMBER

[75] Inventor: Nobuhiro Suzuki, Tokyo, Japan

[73] Assignee: Tomy Kogyo Co., Inc., Tokyo, Japan

[21] Appl. No.: 239,421

[22] Filed: Mar. 2, 1981

[30] Foreign Application Priority Data

Mar. 31, 1980 [JP] Japan ..... 55-42657[U]
Nov. 6, 1980 [JP] Japan ..... 55-158740[U]

[51] Int. Cl.[3] ..... A63F 7/00; A63F 9/06

[52] U.S. Cl. ..... 273/1 L; 273/85 R; 46/41; 46/92; 46/127; 46/130

[58] Field of Search ..... 273/1 L, 85 R, 85 F, 273/85 H; 46/42, 41, 91, 127, 92, 130

[56] References Cited

U.S. PATENT DOCUMENTS 3,477,723 11/1969 Djedda ..... 46/41 X
3,924,350 12/1975 Hsu ..... 273/1 L X
4,032,141 6/1977 Tanimura .
4,136,872 1/1979 Matsumoto .
4,142,715 3/1979 Matsumoto .
4,223,471 9/1980 Greenberg ..... 273/1 L X

FOREIGN PATENT DOCUMENTS 368720 2/1923 Fed. Rep. of Germany ..... 46/41

OTHER PUBLICATIONS

American Folk Toys, Dick Schnacke, pp. 54–57.

*Primary Examiner*—Paul E. Shapiro
*Attorney, Agent, or Firm*—K. H. Boswell; Edward D. O'Brian

[57] ABSTRACT

A hand held housing has a fluid chamber located therein which is divided into a first section and a second section. The fluid chamber is capable of holding a body of fluid. A passageway connects the first and second sections of the chamber. The second section of the chamber includes a membrane which is capable of moving a portion of the body of fluid through the passageway alternately back and forth between the first and second sections of the chamber. The first section has a flat front and rear plate which are parallel planar to each other. Located within the first section of the chamber between the front and rear plates is an essentially planar member having a plurality of parts which are articulatively joined together such that any one of the parts is movable with respect to at least one other of the parts. The member is movable in the first section in response to fluid movement through the passageway from the second section to the first section. However, it is incapable of rotating its plane with respect to the parallel planar of the front and rear plates.

6 Claims, 8 Drawing Figures

Fig. 3
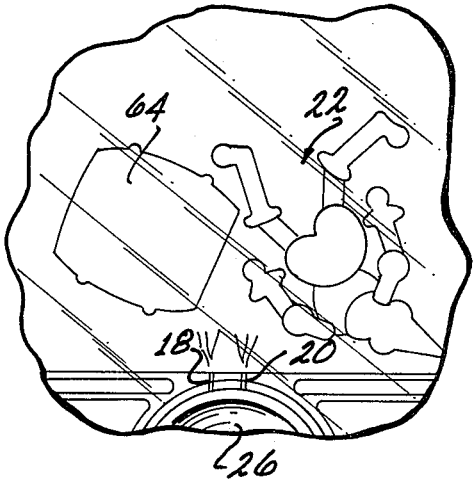
Fig. 4
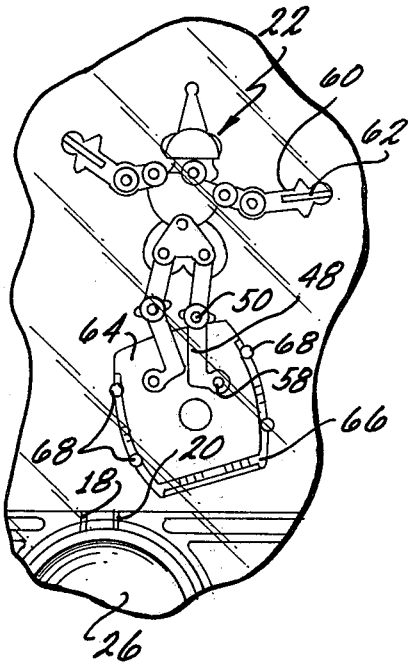
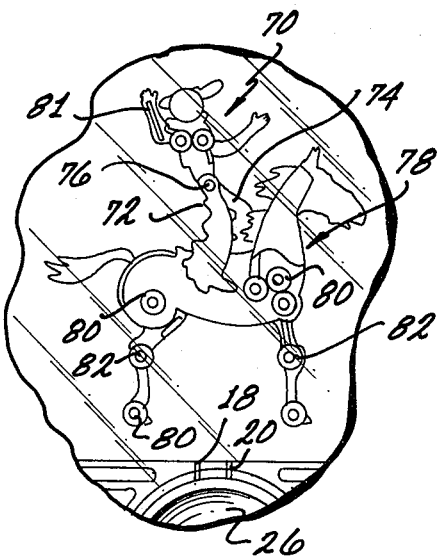
Fig. 5

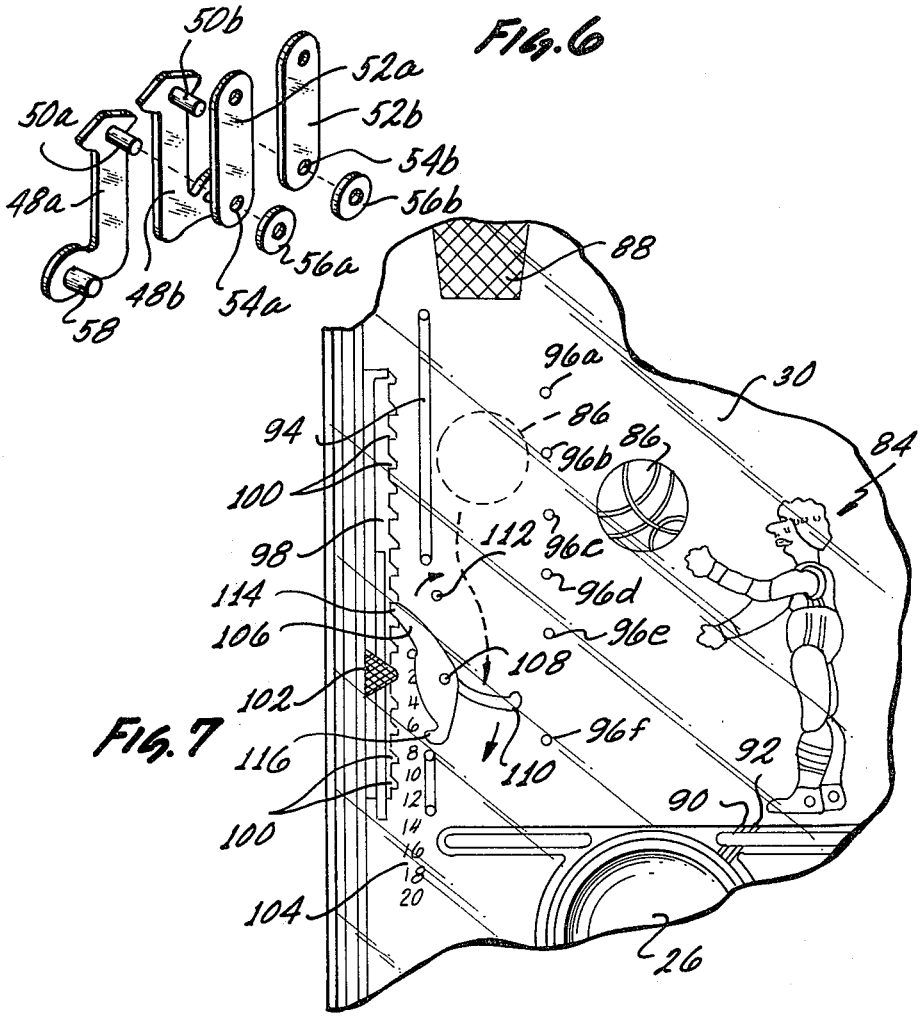
Fig. 6
Fig. 7
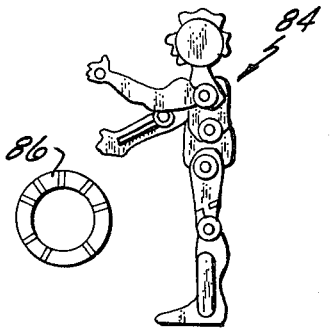
Fig. 8

AMUSEMENT DEVICE WITH FLUID MOVABLE ARTICULATED MEMBER

BACKGROUND OF THE INVENTION

This invention is directed to an amusement device which includes a fluid chamber which is divided into a first and second section. A movable member is located in the first section. A means to cause fluid movement is located in the second section. The movable member is movable in response to fluid movement from the second section into the first section.

A class of toys exists which are classified, in at least one book related to American folk toys, as "flapjacks." These toys include an articulated performer which is suspended on a string which has been twisted and attached to the ends of a pair of handles. The handles are pivoted below the performer and by squeezing the lower end of the handles the strings are tensioned and because of the twist in the strings the performer is lifted up and around the strings. The performer can be made to swing around the strings much as an olympic highbar gymnast does in performing a routine. The arms and legs of the performer are normally articulated to a body allowing them to freely move back and forth as the performer swings.

A second class of toys known as "jumping jacks", in the same above noted catalogue, has a similar type structure wherein a body has a series of articulated limbs attached thereto which are caused to move by pulling a string. This toy essentially utilizes a principle whereby the limbs attaching to the body are first class levers and the string which activates the limbs is attached on one side of the fulcrum and the remainder of the limb extends on the other side of the fulcrum. Both the jumping jack toy and the flapjack toy have provided amusement to generations of children. It has been found that these types of toys are very interesting and have considerable play value. The play value of these toys is demonstrted by the fact that the flapjack type toy is still to be found on the shelves of many toy stores and it is commonly sold at the consession shops in large amusement parks and the like.

Recently a third class of toys has been introduced and has found wide exceptance by the public because of its play value. Their toys are commonly known under the trade name "WATERFULS®." In this type of toy a housing includes a fluid reservoir. Attached to the fluid reservoir is an expandable and contractable bellows. A player operable button is positioned to interact with the bellows expanding and contracting it. In response to movement of the bellows, a fluid, normally water, is ejected from the bellows into the body of the toy. The fluid can be utilized to move a series of rings, balls, etc., throughout the reservoir. A different embodiment of this toy utilizes targets within the reservoir in which to capture rings, balls, etc. The use of the fluid gives this toy a new dimension in that the fluid is used both as a supporting and moving median for the rings, balls, etc. Movement of the fluid is somewhat unpredictable in that the force and stroke of the bellows is variable and thus the fluid movement resulting therefrom within the reservoir is also variable. Further, once a current is set up within the reservoir, any additional currents introduced by the bellows added to or subtract from the previous currents resulting in variable motion of the rings, balls, etc., found within the toy.

It is considered that the flapjack and jumping jack type toys incorporate certain features which have considerable play value. It is further considered that the WATERFUL® type toys also incorporate certain features which have a particular play value. Unfortunately there presently does not exist any type of toy which utilizes the articulated members of the flapjack and jumping jack toys suspended within a fluid median as in the WATERFUL® type toys. It is considered that a toy which did not incorporate the features noted in the previous sentence, would have lasting play value.

BRIEF DESCRIPTION OF THE INVENTION

In view of the above, it is therefore an object of this invention to provide an amusement device which provides for an articulated member suspended within a fluid medium. It is a further object to provide a toy whose construction is such that simplicity, efficiency and economy are achieved in both assembly and operation of the toy.

In view of the above noted objects and others, as will become evident from the remainder of this specification, there is provided an amusement device which comprises; a housing having; a fluid chamber divided into a first section and a second section; said fluid chamber capable of holding a body of fluid; at least one fluid passageway connecting said first and said second sections of said chamber; said second section including means capable of moving a portion of a body of fluid through said fluid passageway alternately between said first and said second sections of said chamber; at least one member having a plurality of parts articulately joined together such that any one of said parts is movable with respect to at least one other of said parts, said member movably, located in said first section and freely movable throughout said first section in response to fluid movement through said passageway from said second section to said first section.

Preferredly the first section of the fluid chamber would include a generally flat face plate and a generally flat rear plate which are spaced from one another in a parallel planar relationship and held there by a wall means which attaches to both the face and rear plates and holds them together. In the preferred embodiment, the member would also be generally planar and be capable of freely rotating within the first section about an axis which is essentially perpendicular to the plane of the member but would be incapable of rotating about axises which essentially lie within the plane of the member. This allows the member to freely tumble and spin within its own plane while concurrently maintaining one side exposed through the face plate. This one side can include appropriate indicia allowing the member to mimic a characterized figure, animal or the like.

Preferredly the means incorporated within the second section for moving the fluid would include a flexible membrane. The flexible membrane would be capable of being flexed by the operator of the toy to increase and decrease the volume of the second section causing fluid to flow through the passageway between the first and second section. The fluid movement into the first section is therefore available for moving the articulated member within the first section.

In a different embodiment of the invention, an additional member, if desired, can be incorporated within the first section. This additional member could be similar to the first member that is a member having a plurality of parts which are articulately joined together or alternately the additional member could be a unified member having no movable parts but itself being movable within the first section. The unified member preferredly would be constructed such that the articulated member would be capable of interacting with the unified member.

In another embodiment of the invention the first section of the fluid chamber could also incorporate a target means and further a scoring means associated with the target means. In this embodiment, a second member, whether it be fixed or articulated, would be used as an object to be directed toward the target means.

BRIEF DESCRIPTION OF THE DRAWINGS

The invention disclosed in this specification will be more readily understood when taken in conjunction with the figures wherein:

FIG. 3 is a partial plan view similar to that of FIG. 1 but showing certain of the components in a different special relationship than that shown in FIG. 1;

FIG. 4 is a partial plan view showing the back side of the component shown in FIG. 3, however, these components are in a different special relationship with respect to one another from that seen in FIG. 3;

FIG. 5 is a plan view of an alternate embodiment of the portion of the invention showing the movable components of the invention as they are expressed in this alternate embodiment;

FIG. 6 is an exploded oblique view of a portion of one of the movable components of the invention showing exploded form to demonstrate construction of this component;

FIG. 7 is a partial plan view of a second alternate embodiment of the invention only showing that portion of the invention differing from the invention as shown in FIG. 1;

FIG. 8 is a back elevational view of certain of the components shown in FIG. 7.

Figure 1:
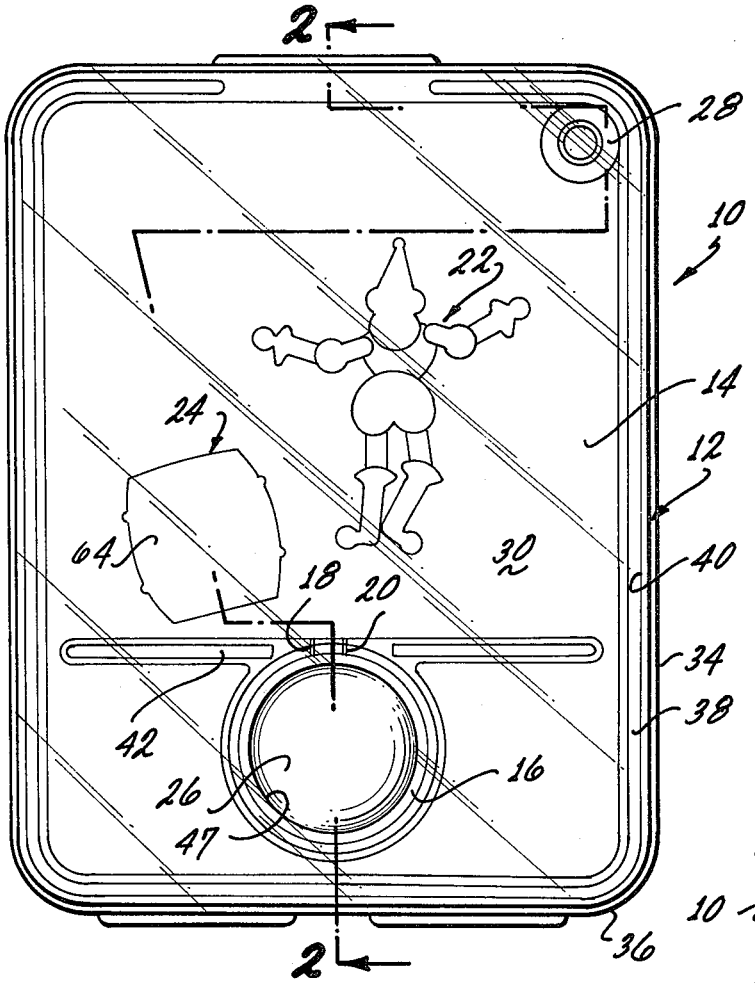
FIG. 1 is a plan view of one of the embodiments of the invention.

The invention described in this specification and shown in the drawings utilizes certain principles and or concepts set forth in the claims appended to this specification. Those skilled in the toy arts will realize that these principles and or concepts could be used in a variety of different embodiments differing from the exact embodiments which are illustrated and described here for illustrative purposes. For this reason this invention is not to be construed as being limited to the exact embodiments depicted herein but is to be construed only in light of the claim.

DETAILED DESCRIPTION OF THE INVENTION

Figure 2:
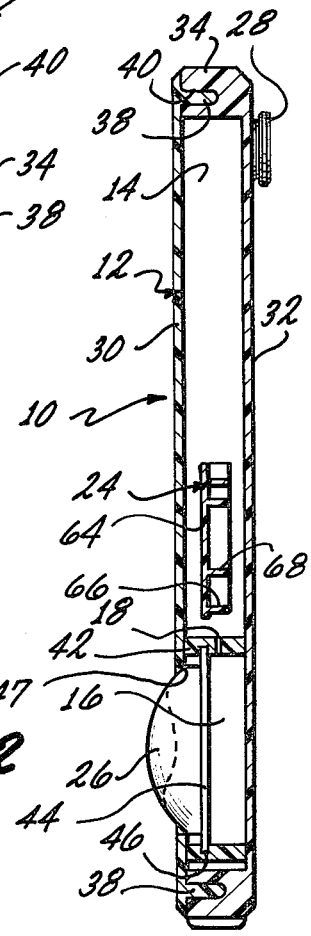
FIG. 2 is a side elevational view taken about the line 2—2 of FIG. 1.

In FIG. 1 of the figures, a plan view of the invention is shown. FIG. 2 shows a side elevational view about the line 2—2 of FIG. 1 to further illustrate the general working principles of the invention. The remaining figures show details of particular embodiments of the invention. All of the embodiments shown in FIGS. 3 through 8 would utilize the same major components as are shown in FIGS. 1 and 2.

The amusement device 10 of the invention in its preferred form and when considered from an overall view, includes a housing component 12 having a first section 14 of a fluid chamber (not separately numbered) and a second section 16 of a fluid chamber. Fluid passageways 18 and 20 connect the first and second sections 14 and 16 of the fluid chamber. Located within section 14 is an articulated member 22 as well as a unified member 24. Both members 22 and 24 are free to move within the confines of first section 14. A flexible membrane 26 covers the second section 16 of the fluid chamber. A flexible stopper 28 fits within a hole (not separately shown or numbered in the figures) allowing for introduction of fluid into the first section 14 of the chamber and from there through the fluid passageways 18 and 20 into the second section 16 of the chamber.

A fluid, preferredly water, is introduced into the chamber to fill both first and second sections 14 and 16 and then the chamber stopped up via stopper 28 to retain the fluid therein. Once filled with fluid the amusement device 10 works as follows. By depressing the flexible membrane 26, fluid is forced from the second chamber 16 into the first chamber 14 through the passageways 18 and 20. In moving through the passageways 18 and 20 into the first section 14, the fluid so ejected from the second section 16 causes currents and other fluid movement within the first section 14. Current movement within the first section 14, results in movement of both the articulated member 22 and the unified member 24.

In the embodiment illustrated in FIGS. 1 through 4, it is the expressed purpose to attempt to deposit the articulated member 22 inside of the unified member 24 as herein explained. In FIG. 4, as viewed on the back of the device, the articulated member 22 can be seen entering the interior of the unified member 24. When the flexible membrne 26 is released, because a finite volume of both liquid and gas are confined within the device 10 by the flexible stopper 28 the internal pressure, usually generated upon depression of the flexible member, pushes the flexible membrane from the position shown in phantom line to the position shown in solid line in FIG. 2 concurrently as fluid moves from the first section 14 into a second section 16. The flexible membrane 26 is now once again in position to be depressed against to eject fluid through the passageways 18 and 20 to further move both members 22 and 24 within the first section 14.

The housing 12 consists of a face plate 30 which is held in a parallel planar relationship with the rear plate 32 such that the first section of the chamber 14 is essentially rectilinear in cross-section as can be seen in FIG. 2. A flange 34 projecting outwardly from rear plate 32 around its total periphery forms a part of a continuous wall 36. The remaining portion of wall 36 is formed by flange 38 which projects rearwardly from the face plate 30 and fits into a groove 40 formed in the flange 34. The wall 36 is thus composed of a lock and key type arrangement between respective flanges projecting from the face and rear plates 30 and 32. The wall 36 completely surrounds the perimeters of the face and rear plates 30 and 32 and forms a fluid tight seal between them. The flange 38 is appropriately held within the grove 40 by solvent welding or the like.

A continuous interior wall 42 divides the second section 16 from the first section 14. The passageways 18 and 20 are formed in this interior wall. The flexible member 26 includes a flange 44 which appropriately fits within a grove 46 in the interior wall 42. The flange 44 forms a fluid tight seal with the wall 42. The flexible member 26, in the preferred embodiment described herein, is shaped as a semi-sphere and a portion of it projects through an appropriate opening 47 located in face plate 30.

Referring now to FIG. 6, the structure of a portion of the articulated member 42 will be described in detail. Identical construction details are also utilized in the remaining portion of the articulated member 42 as well as other articulated members described herein. The lower leg portions 48 a and b of the articulated member 42 each have bosses 50 a and b projecting from their back side. The thigh portions 52 a and b contain appropriate circular openings 54 a and b of a diameter slightly larger than the diameter of the bosses 50 a and b. The thigh portion fit over the bosses 50 a and b are retained thereon by bushings 56 a and b which are pressed fit over the bosses 50 a and b. This forms an articulated joint between the members 48 and 52.

At the lower end of member 48 is another boss 58. The boss 58 serves to maintain the end of the lower end 38 spaced away from the rear plate 32 same distance that the boss 50 maintains the upper end 38. This prevents the member 48 from becoming jamed between the two plates 30 and 32. Other appropriate spacing bosses or tabs as herein identified located on the extremities of other articulated parts in the other embodiments below serve the same function. Thus aforementioned member 60 includes a tab 62 on this end.

The unified member 24, as shown in FIG. 2, includes a face plate 64 and a U-shaped wall 66 attached to it. The U-shaped wall 66 includes the plurality of spacer tab 68 which maintains the face plate 64 of the unified member 24 a particular distance away from rear plate 32 allowing the articulated member 22 to fit between the face plate 64 and the rear plate 32 of the housing 12 as is partially seen in FIG. 4. In the embodiment shown in FIGS. 1, 3 and 4 the articulated member 22 can partially fit within the interior of the unified member 24. Because of the articulated joining of the component parts of the member 22, it essentially can fold up and slump inside the unified member 24. The presence of the bottom portion of the U-shaped wall 66 prevents the articulated member 22 from going completely through the unified member 24, however, in other embodiments the member could be essentially a hollow tube or arch allowing the articulated member 22 to go completely threre-through.

In FIG. 5 a second embodiment of the articulated member 22 is shown. In this embodiment, articulated member 70 is constructed as a figurine as was member 22. This figurine differs however, in that it lower limbs 72 and 74 are joined about a common pivot boss 76. This spaces limb 72 from limb 74 allowing the member 70 to slide over a second articulated member 78. In the embodiment of FIG. 5, member 70 is shaped as a cowboy and member 78 is shaped as a horse. The spacing of the lower limb 72 from 74 allows the cowboy to be positioned on the back of the horse 78. Projecting out of the horse 78 on its backside in appropriately positioned places are bosses collectively indentified by the numeral 80. These bosses are spacing bosses and act in the same manner as boss 58, tab 62 and the like previously described. Further, a spacing tab 82 is found on one of the upper limbs of member 70. In addition to the spacing tabs 80, the member 78 also has rotational bosses 82 by which its parts are articulately joined in the same manner as was described in discussing FIG. 6. The member 70 and the member 78 are free to fold and bend about their points of articulation further contributing to the play value of the amusement device.

In FIGS. 7 and 8 a further alternate embodiment of the invention is shown. In these figures a member 84, which is articulated as per members 72, 70 and 78 were, interacts with a unified member 86. Opposed to FIG. 1, however, the interaction of articulated member 84 with unified member 86 is somewhat different than the interaction between the articulated member 22 and unified member 24. In the embodiment of FIG. 7 it is the express purpose to use the articulated member 84 to assist in propelling the unified member 86 toward a target. FIG. 8 illustrates the backside of both members 84 and 86 showing the articulated construction of the member 84 including appropriate bosses and tabs to serve as joining points and as spacing points.

In FIG. 7 the articulated member 84 is shown assisting the unified member 86 upwardly toward an indicia imprinted on face plate 30. The indicia 88 is in the shape of a basketball basket or hoop. Note that the passageways 90 and 92 are slanted toward the right in contrast to the passgeways 18 and 20 of FIG. 1. Thus water or other fluid ejected from the second section 16 does not point toward the indicia 88 but in fact points somewhat away from it. This requires the use of the articulated member 84 in assisting unified member 86 upwardly toward indicia 88.

Extending downwardly directly below the indicia 88, is a baffle 94 and a series of bosses 96 a through f. Both the baffle 94 and the bosses 96 extend inwardly from the backside of face plates 30. Together the baffle 94 and the bosses 96 form a channel leading downwardly below the indicia 88. The path of the unified member 86 through this channel is shown in phantom lines in FIG. 7. It is noted that bosses 96 e and f are spaced apart one from the other at a distance allowing passage of the unified member 88 between them.

Located between baffle 94 and side wall 36 is a sliding member 98 having a plurality of teeth collectively identified by numeral 100 located thereon. Also printed on sliding member 98 is an indicia pointer 102. A set of indicia collectively identified by the numeral 104 is located on face plate 30 and it represents typical scores in a basketball game i.e. 0, 2, 4, 6, etc. As the sliding member 98 descends downwardly, the pointer 102 progressively moves from one numeral to the next highest numeral as follows. A scoring member 106 is pivotly mounted about boss 108 which is formed as a projection from the back of face plate 30 such that normally its weight, under the influence of gravity, will tend to maintain it in the position shown in FIG. 7. If, however, the member 86 strikes it about its lever arm 110 the weight of the member 86 will cause the scoring member 106 to pivot about boss 108. Note that silghtly prior to striking the lever arm 110 the member 86 strikes boss 112 formed on the face plate 30 which causes the member 86 to jog out slightly to the right as per the planthom line pathway shown in FIG. 7.

The upper dog 114 on the scoring member 106 engages one of the teeth 100 in the position shown in FIG. 7. When the scoring member 106 rotates the lower dog 116 engages the wedge shape surface of the teeth 100 forcing the sliding member 98 downwardly until the dog 114 engages the next higher tooth. This results in the sliding member 98 moving one increment such that the scoring pointer 102 moves between one of the indicia 104 to the next downwardly displaced indicia 104. After the scoring member 106 has rotated clockwise to the limit possible because of the interaction of the dog 114 with the sliding member 98, the member 86 rolls to the right between the bosses 96 e and f putting it again in position wherein it can be moved by fluid being expelled through the passageways 90 and 92. The scoring member 106 will then rotate counterclockwise under the influence of grvity until the upper dog 114 is in position engaged with the one tooth 100 which is one tooth higher than the tooth it was previously engaged with. In a like manner, each time the member 86 passes between the baffle 94 and the bosses 96, the scoring member 106 is rotated about the boss 108 and the sliding member 98 moves down one increment.

It can be seen that in all of the alternate embodiments herein described, the articulated members are capable of unique movements throughout the first section 14 of the chamber. Because of the manner of joining these members together, comprising having a plurality of parts joined in an articulated manner, the articulated members have movements similar to that of string puppets and the like. The articulated members and the unified members can be made to do a variety of different things within the confine of the first chamber. As is seen in FIGS. 1 through 4, an articulated member and a unified member can be made to interact with each other. As seen in FIG. 5, two articulated members can be made to interact with each other and as seen in FIG. 7, an articulated member and a unified member can be made to interact with a further device located within the confines of the amusement device 10. Of course other permutations and combinations of these members and devices will be readily apparent given the disclosure herein.

The amusement device 10 herein described is capable of being conveniently and comfortably held within one's hand and is a size that it is easily fitted within pocket or purse which allows for portability of the device. Preferredly both the face plate 30 and the rear plate 32 are made of a transparent material allowing complete viewing of the parts located within, however, the rear plate, at least, can be made of an opaque material forming a contrasting background for the members located therin and disguising the method of joining of the articulated members.

As is evident from the figures when viewed from the front, that is through the face plate 30, the method of joining the individual parts of the articulated members are not readily apparent. Further the tabs, such as tab 62 of the member 22 showing in FIG. 4, while serving as spacers, additionally serve as baffles to interact with motion of the fluid within the first section 14 of the fluid chamber. Appropriate placement of these tabs will allow for preferential movement of one part of a member over another. Thus for the clown figure shown in FIGS. 1 through 4 the tab 62 located on one of the upper extremities results in more movement of that extremity with respect to other parts such as the head (not identified or numbered). This contributes to the movement of the articulated figure in the amusement device 10.

I claim:

1. An amusement device which comprises:

a housing having;

a fluid member divided into a first section and a second section;

said fluid chamber capable of holding a body of fluid;

at least one fluid passageway connecting said first and said second sections of said chamber;

said second section including means capable of moving a portion of a body of fluid through said fluid passageway alternately between said first and said second sections of said chamber;

said first section including a generally flat face plate, a generally flat rear plate and a wall means, said wall means attaching to both said face plate and said rear plate maintaining said face plate and said rear plate spaced a distance apart from each other in a parallel planar relationship with one another;

at least one generally planar member having a front side and a rear side, said member including a plurality of parts articulately joined together such that any one of said parts is movable with respect to at least one other of said parts, said member movably located in said first section with its front side located towards said face plate and freely movable throughout said first section in response to fluid movement through said passageway from said second section to said first section, said member sized with respect to the distance between said face plate and said rear plate so as to be incapable of rotating within said first section to locate its rear side towards said face plate.

2. The device of claim 1 wherein:

said means capable of moving said portion of said body of fluid comprises a flexible membrane forming a portion of said second section, said membrane flexibly movable with respect to said housing, the volume of said second section variable with respect to movement of said flexible membrane.

3. The device of claim 2 including:

at least two members having a plurality of parts articulately joined together.

4. The device of claim 3 wherein:

one of said two members is capable of locating at least one of its parts justapositional to one of the parts of the other of said members.

5. The device of claim 2 including:

at least one second member, said second member being unified body and capable of interacting with said member having a plurality of parts articulately joined together.

6. The device of claim 5 including:

sliding means located in association with said first section of said chamber, said sliding means having at least one movable part, said movable part capable of moving in response to interaction of said movable part by one of said members.

* * * * *